US006469725B1

(12) United States Patent
Nagahata

(10) Patent No.: US 6,469,725 B1
(45) Date of Patent: Oct. 22, 2002

(54) THERMAL PRINTHEAD

(75) Inventor: Takaya Nagahata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/980,412

(22) PCT Filed: May 31, 2000

(86) PCT No.: PCT/JP00/03535

§ 371 (c)(1),
(2), (4) Date: Nov. 30, 2001

(87) PCT Pub. No.: WO00/76776

PCT Pub. Date: Dec. 21, 2000

(30) Foreign Application Priority Data

Jun. 14, 1999 (JP) ..... 11-166699

(51) Int. Cl.[7] ..... B41J 2/35
(52) U.S. Cl. ..... 347/209
(58) Field of Search ..... 347/188, 192, 347/210, 209; 400/120.12, 120.09

(56) References Cited

U.S. PATENT DOCUMENTS 5,760,813 A 6/1998 Yamaguchi et al.

FOREIGN PATENT DOCUMENTS

| | | |
|---|---|---|
| JP | 63-233855 | 9/1988 |
| JP | 07-186432 | 7/1995 |
| JP | 10-129026 | 5/1998 |

*Primary Examiner*—Huan Tran
(74) *Attorney, Agent, or Firm*—Merchant & Gould P.C.

(57) ABSTRACT

A thermal printhead includes a plurality of heating elements (6) heated by a head voltage for printing on a recording paper, and a plurality of drive IC's (3) powered by a logic voltage for driving the heating elements (6). The printing is performed at whatever value of the head voltage within a range from 2.7 volts through 8.5 volts. Further, the drive IC's (3) operate at whatever value of the logic voltage within a range from 2.7 volts through 5.5 volts.

8 Claims, 7 Drawing Sheets

THERMAL PRINTHEAD

TECHNICAL FIELD

The present invention relates to a thermal printhead including a plurality of heating elements and a plurality of drive IC's which control operation of these heating elements. The present invention also relates to a printer incorporating such a thermal printhead.

BACKGROUND ART

In recent years, portable printers and copiers are becoming popular. These portable apparatuses are powered by batteries, and include a thermal printhead for making a print on a predetermined recording paper.

Generally, the thermal printhead includes a plurality of heating elements and a plurality of drive IC's for controlling these heating elements. In order to print, the heating elements must be supplied with a head voltage, whereas the drive IC's must be supplied with a logic voltage. In the portable apparatus, the head voltage and the logic voltage are supplied by the batteries incorporated in the apparatus.

Therefore, in the portable apparatus, it is required that power consumption be small, and a drive voltage be low. Further, consideration must be paid to a decrease in power voltage during use.

Given these requirements, in a conventional thermal printhead, improvement has been made to the construction of the heating elements in order to reduce power consumption and to enable use at a low head voltage.

However, according to the conventional thermal printhead, the logic voltage is fixed to 3.3 volts or 5 volts. For this reason, at least two kinds of the thermal printhead have to be designed and manufactured, resulting in a problem of increased manufacturing cost. Another problem is that in order to avoid reduction in the logic voltage due to use over a period of time, the supply of the logic voltage from the batteries is made via a DC—DC converter, resulting in a problem of increased parts cost and assembling cost.

DISCLOSURE OF THE INVENTION

The present invention is made under these circumstances, and it is an object of the present invention to provide, without increasing the cost of manufacture as long as possible, a thermal printhead capable of operating at any power voltage in a range assumed for the battery power.

Another object of the present invention is to provide a portable printer incorporating such a thermal printhead.

In order to achieve the objects, the present invention makes use of the following technical means.

A thermal printhead provided by a first aspect of the present invention comprises a plurality of heating elements heated by a head voltage for printing on a recording paper, and a plurality of drive IC's powered by a logic voltage for driving the heating elements. The printing can be performed at whatever value of the head voltage within a range from 2.7 volts through 8.5 volts.

The printing paper may be a thermal paper. If the thermal paper is not used, an ink ribbon may be used.

According to a preferred embodiment of the present invention, the drive IC's operate at whatever value of the logic voltage within a range from 2.7 volts through 5.5 volts.

Preferably, the head voltage and the logic voltage can be set independently of each other.

Preferably, the thermal printhead according to the present invention further comprises voltage varying means for varying a pulse width of the head voltage during the printing in response to variation in the head voltage.

Preferably, each of the heating elements has an effective print length in a sub-scanning direction, a pixel to be printed per printing datum has a print length in the sub-scanning direction, and the effective print length is generally equal to an n-th of the print length. Herein, n is a natural number not smaller than 2.

Preferably, each of the drive IC's incorporates a plurality of transistors connected to the heating elements.

Preferably, the transistors are MOS field effect transistors.

A printer provided by a second aspect of the present invention comprises power supply means and a thermal printhead. The thermal printhead includes a plurality of heating elements heated by a head voltage for printing on a recording paper, and a plurality of drive IC's powered by a logic voltage for driving the heating elements. The printing is performed at whatever value of the head voltage within a range from 2.7 volts through 8.5 volts.

Preferably, the drive IC's operate at whatever value of the logic voltage within a range from 2.7 volts through 5.5 volts.

Preferably, the power supply means includes a battery.

According to the present invention, as long as the head voltage supplied to the heating elements is within the range from 2.7 volts to 8.5 volts, it is possible to form an image on the printing paper. Further, as long as the logic voltage supplied to the drive IC's is within the range from 2.7 volts to 5.5 volts, it is possible to drive the drive IC's. Therefore, operation becomes possible at any power voltage in a range assumed for the battery power. Further, the invention eliminates the need to design and manufacture two kinds of the thermal printhead. Thus, it becomes possible to reduce the cost of manufacture including development cost.

Other characteristics and advantages of the present invention will become clearer from the following description in detail to be presented with reference to the accompanying drawings.

BEST MODE FOR CARRYING OUT THE INVENTION

Hereinafter, a preferred embodiment of the present invention will be described specifically, with reference to the attached drawings.

Figure 1:
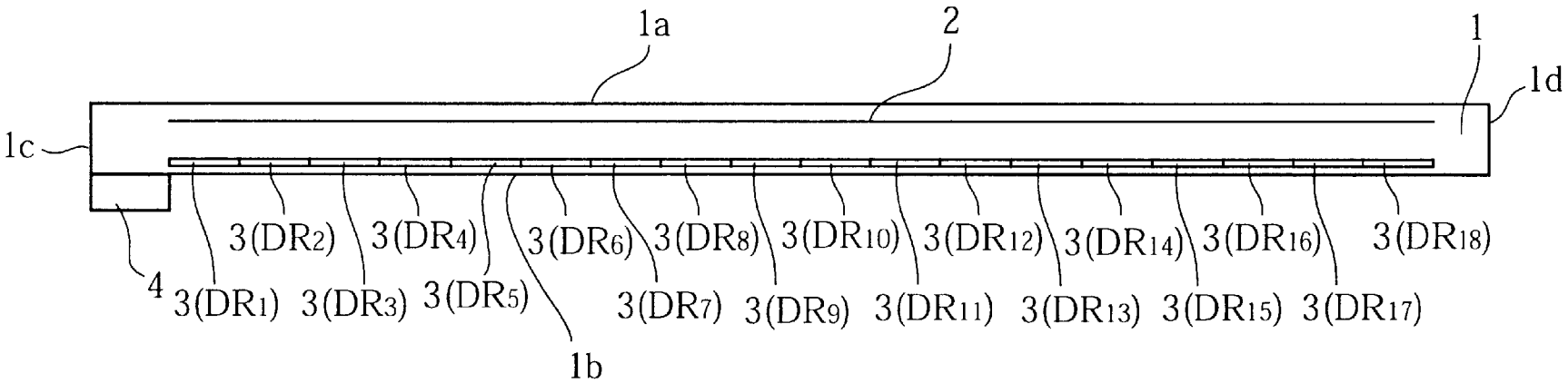
FIG. 1 is a plan view of a thermal printhead according to the present invention.

FIG. 1 is a plan view, showing an outline of a thermal printhead according to the present invention. The illustrated thermal printhead includes an oblong rectangular substrate 1, a heating resister 2 extending longitudinally of the substrate 1, a plurality of drive IC's 3 disposed in a row (a total of 18 drive IC's Dr 1–DR 18 according to FIG. 1), and a connector 4.

The substrate 1 includes a first edge 1*a* extending longitudinally of the substrate, and a second edge 1*b* facing away from the first edge. Further, the substrate 1 includes first end 1*c* and a second end 1*d* facing away from each other longitudinally of the substrate. The heating resister 2 extends along the first edge 1*a,* whereas the drive IC's 3 are disposed along the second edge 1*b*. The connector 4 is attached closely to the first end 1*c* on the second edge 1*b*. The connector 4 accepts a cable (not illustrated), through which the heating resister 2 and the drive IC's are supplied with power and various signals.

Figure 2:
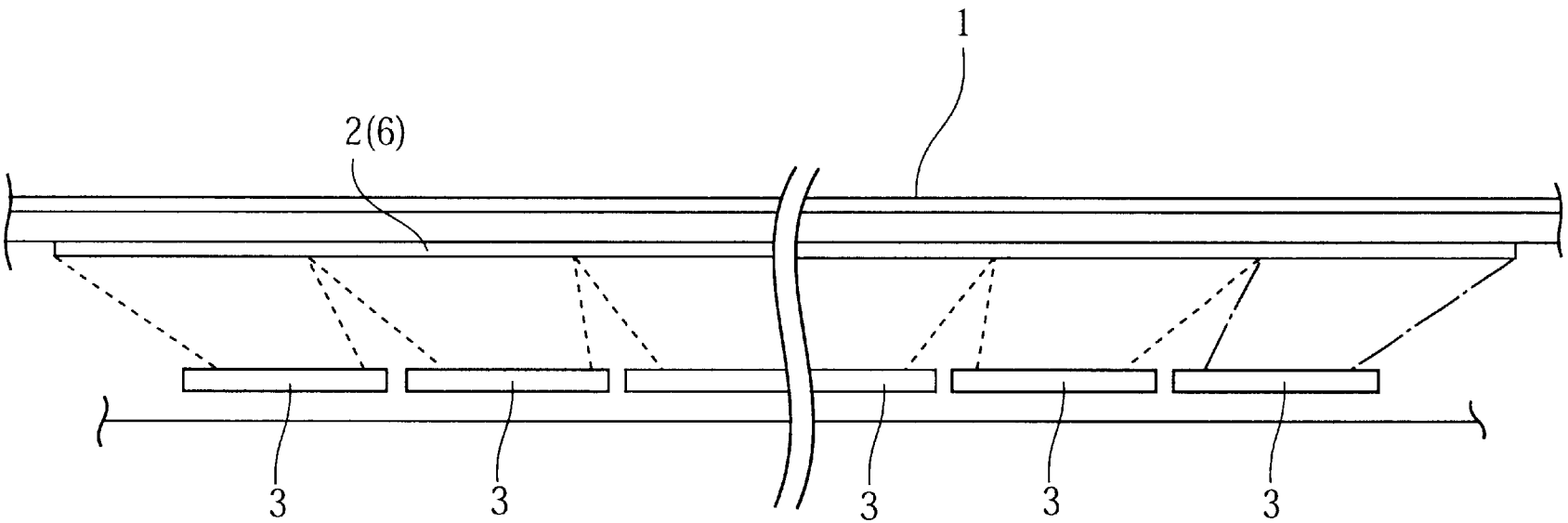
FIG. 2 is an enlarged view showing a principal portion of the thermal printhead in FIG. 1.

FIG. 2 is an enlarged view of the substrate 1. As shown in this figure, the drive IC's 3 are placed slightly apart from the adjacent ones. Each of the drive IC's 3 drives heating elements (indicated by reference code 6 in FIG. 3) formed at a predetermined portion of the heating resister 2. Each drive IC drives a total of 96 heating elements for example.

Figure 3:
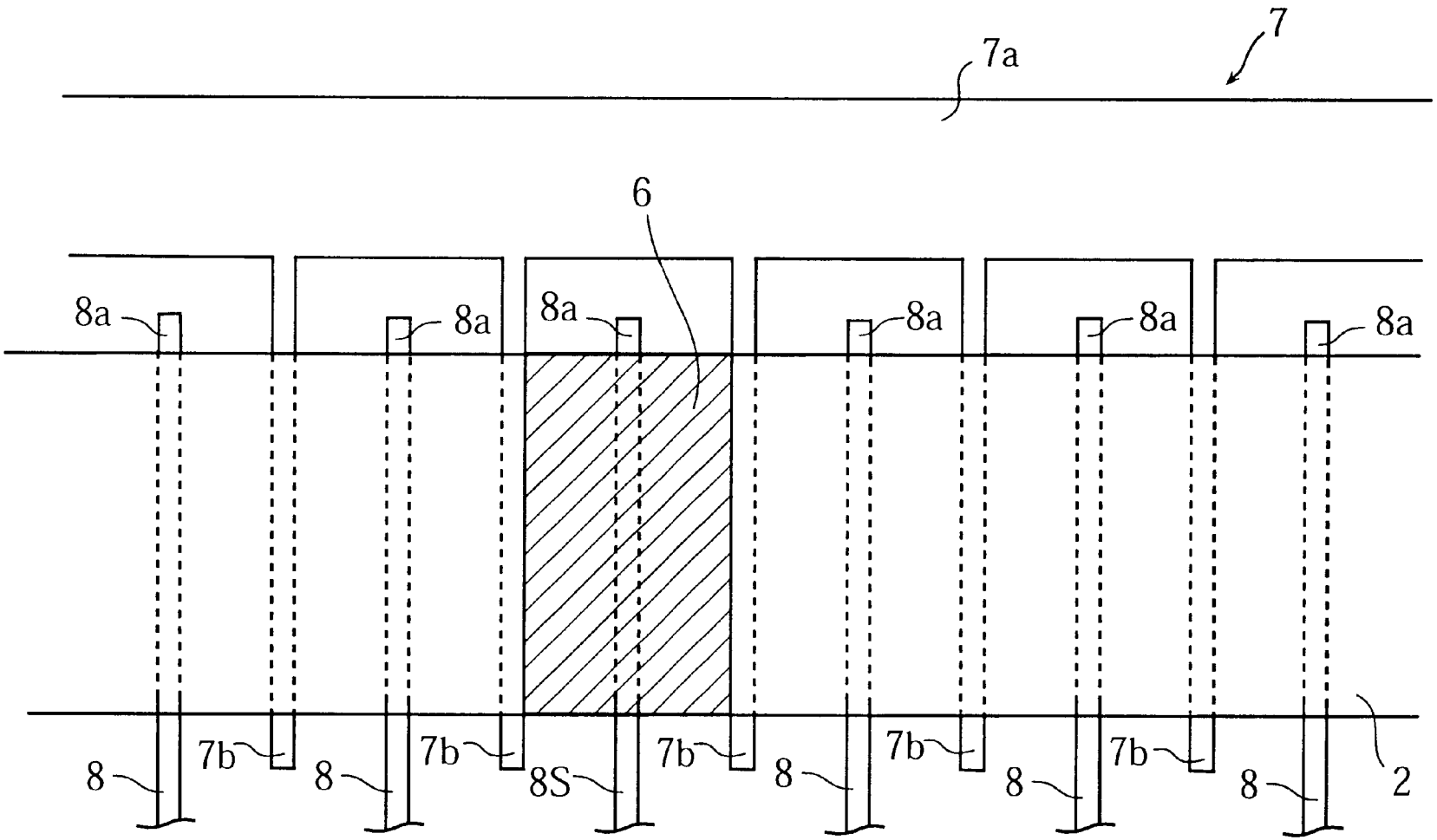
FIG. 3 is an enlarged plan view showing a heating resister of the thermal printhead in FIG. 1.

FIG. 3 is an enlarged plan view, showing a part of the heating resister 2 and surrounding members. As shown in this figure, the heating resister 2 is electrically connected to a common electrode 7 and a plurality of individual electrodes 8. More specifically, the common electrode 7 includes a common conductor 7*a* and a plurality of comb-teeth-like conductors 7*b* (hereinafter simply called "teeth 7*b*"). The common conductor 7*a* extends in parallel to the heating resister 2. The teeth 7*b* extend perpendicularly to the common conductor 7*a* while contacting a lower surface of the heating resister 2. Likewise, each of the individual electrodes 8 extends while contacting the lower surface of the heating resister 2. Each individual electrode 8 has an end 8*a* between two adjacent teeth 7*b,* and near the common conductor 7*a* of the common electrode 7. Though not illustrated, the individual electrode has another end near a corresponding one of the drive IC's 3, and is electrically connected to an output pad of this drive IC 3 via a wire.

Each drive IC 3 selectively grounds the individual electrode 8 in accordance with inputted image data, thereby completing a closed circuit starting from the positive terminal of the battery, through the common electrode 7 (including the common conductor 7*a* and the teeth 7*b*), the heating resister 2, and the selected individual electrode 8, then to the negative terminal of the battery. As a result, electric current flows through a predetermined region of the heating resister 2, heating the region. More specifically, refer to FIG. 3 and assume that one individual electrode 8S, that is the third one from the left, is selected. The individual electrode 8S is sandwiched by two adjacent teeth 7*b,* and these two teeth define a specific region (hatched portion) 6 of the heating resister 2. When the closed loop is formed, the electric current flows through this specific region 6 and heat is generated.

As will be understood easily, selection of any other individual electrode 8 than the individual electrode 8S defines a corresponding heating region in the heating resister 2. In this way, the heating resister 2 provides a plurality of heating regions corresponding to the number of individual electrodes 8. Hereinafter, these heating regions will be called "heating elements".

Figure 4:
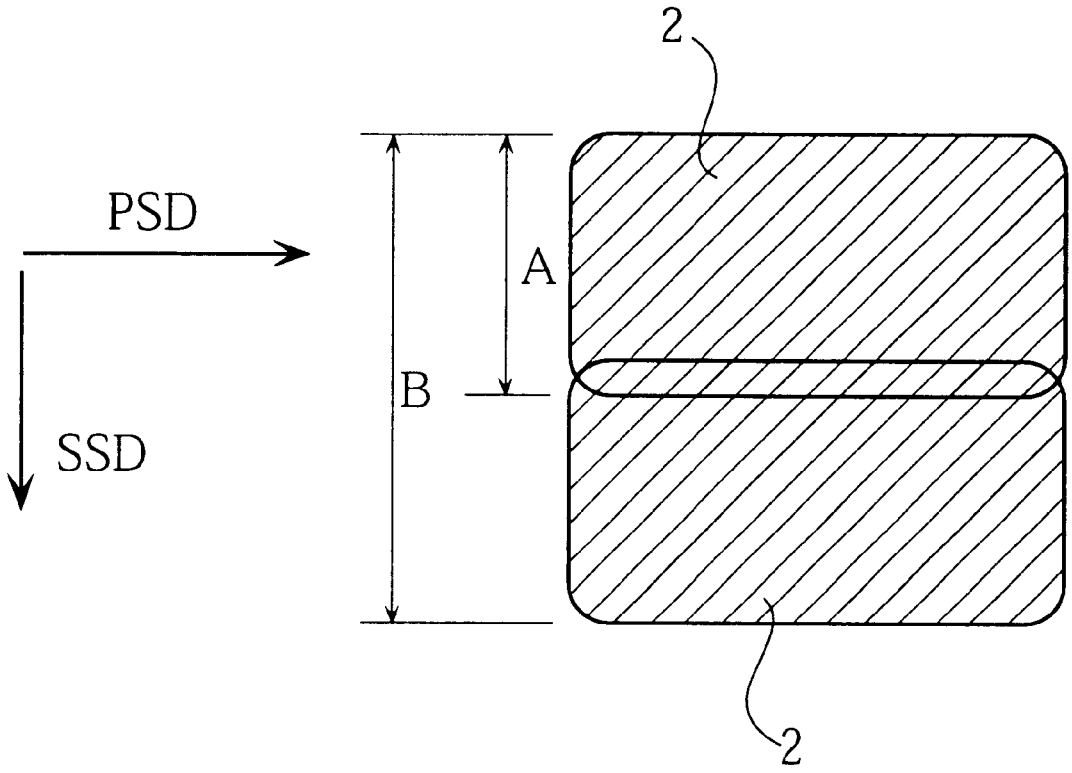
FIG. 4 is a plan view showing a relationship between an effective printing region of a heating element and a pixel.

As shown in FIG. 4, each of the heating elements 6 has an effective print length A in a sub-scanning direction SSD (which is perpendicular to a primary scanning direction PSD). On the other hand, one pixel to be printed on the basis of one printing datum has a length B in the sub-scanning direction SSD. As understood from the figure, the effective print length A is generally equal to a half of the length B. More accurately, the effective print length A is slightly larger than the half of the length B. Therefore, one pixel is formed by two printing strokes in the sub-scanning direction SSD, using the same printing data.

The drive IC's 3 will be described hereinafter.

Figure 5:
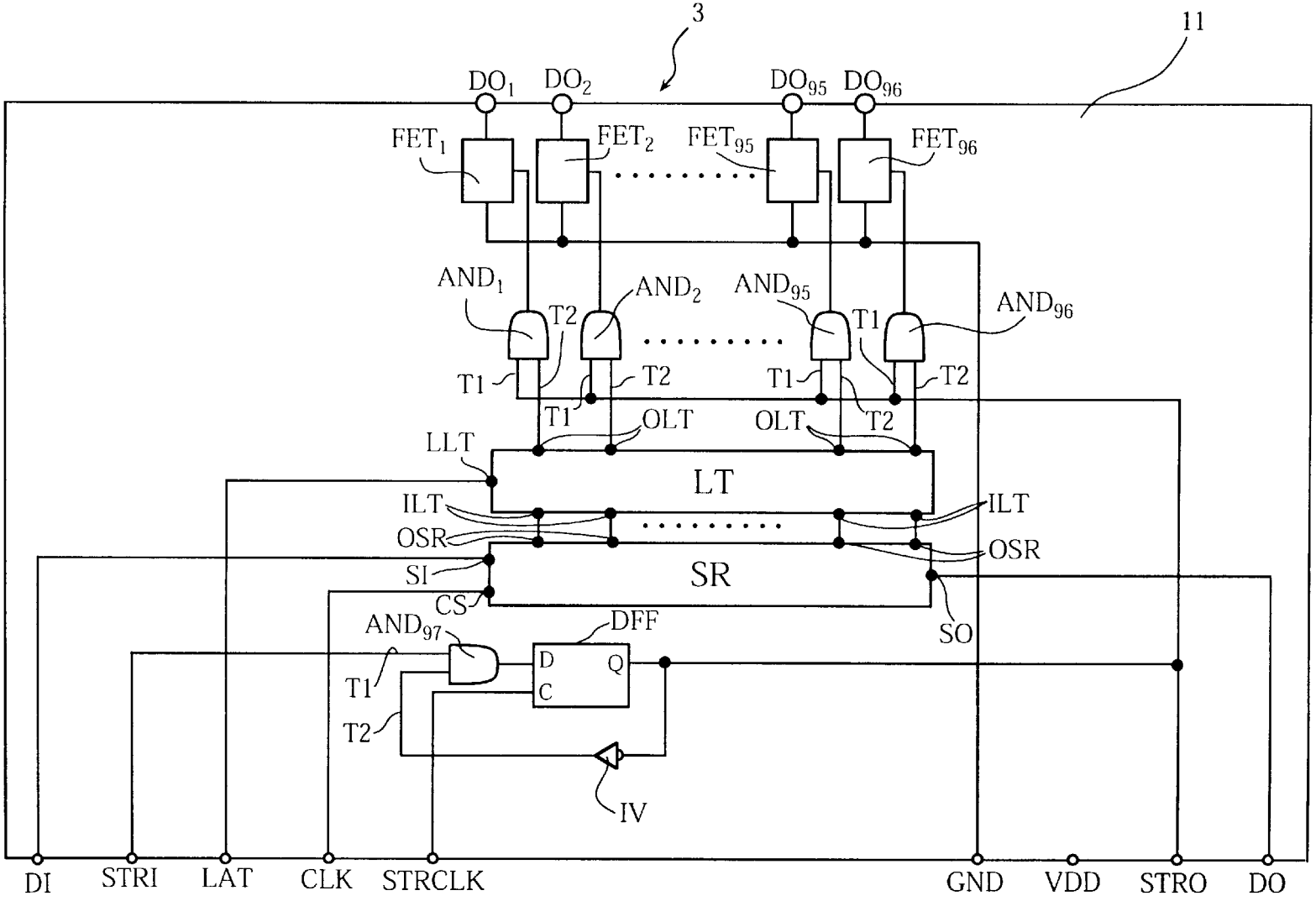
FIG. 5 is a circuit block diagram of a drive IC provided in the thermal printhead in FIG. 1.

As shown in FIG. 5, each of the drive IC's 3 has a chip 11, which includes a shift register SR, a latch circuit LT, a total of 97 AND circuits AND 1–AND 97, a total of 96 field effect transistors FET 1–FET 96, an inverter IV, aD flip-flop circuit DFF, and pads DI, STRI, LAT, CLK, STRCLK, GND, VDD, STRO, DO and DO1–DO 96. Each of the AND circuits AND 1–AND 97 is provided by a MOS field effect transistor.

Generally, the conventional drive IC is provided with a voltage reduction circuit in order to stop circuit operation when the logic voltage has decreased to or beyond a predetermined value. For example, if the logic voltage of the drive IC is set to 5 volts, the voltage reduction circuit stops the circuit operation when the logic voltage has decreased to 3.7 volts or lower. On the contrary, the drive IC 3 shown in FIG. 5 is not provided with a voltage reduction circuit. Therefore, the operation of the drive IC 3 does not top even if the logic voltage supplied to the pad VDD has decreased to 3.7 volts or lower.

Each of the field effect transistors FET 1–FET 96 has three electrodes, i.e. source, drain and gate. All of the sources of these field effect transistors FET 1–FET 96 are connected to the pad GND. The drain of the field effect transistor FETi ($1 \leqq i \leqq 96$) is connected to the pad DOi ($1 \leqq i \leqq 96$). The gate of the field effect transistor FETi ($1 \leqq i \leqq 96$) is connected to an output terminal of the AND circuit ANDi ($1 \leqq i \leqq 96$).

Each of the AND circuits AND 1–AND 96 has two input terminals, i.e. a first input terminal T1 and a second input terminal T2. In each AND circuit, the first input terminal T1 is connected to the pad STRO, and the second input terminal is connected to an output terminal OLT of the latch circuit LT. The latch circuit LT has an input terminal ILT, which is connected to an output terminal OSR of the shift register SR. The latch circuit LT has a latch signal input terminal LLT, which is connected to the pad LAT.

The shift register SR has a serial input terminal SI, a clock input terminal CS, and a serial output terminal SO. The serial input terminal SI is connected to the pad DI. The clock signal input terminal CS is connected to the pad CLK. The serial output terminal SO is connected to the pad DO.

The D flip-flop circuit DFF has an input terminal D, an output terminal Q and a clock signal input terminal C. The input terminal D is connected to an output terminal of the AND circuit AND 97. The output terminal Q is connected to the pad STRO and an input terminal of the inverter IV. The clock signal input terminal C is connected to the pad STRCLK. The AND circuit AND 97 has its first input terminal T1, connected to the pad STRI, and the second input terminal T2 connected to an output terminal of the inverter IV.

Each of the field effect transistors FET 1–FET 96 has a plurality of source regions and a plurality of drain regions. Further, each field effect transistor has a gate electrode surrounding these source regions and the drain regions. The source regions are connected with each other. Likewise, the drain regions are also connected with each other. This construction enables to favorably decrease resistance when each field effect transistor is turned on. The MOS field effect transistor having such a construction is disclosed for example in JP-A-10(1998)-65146 and JP-A-7(1995)-221192.

Figure 6:
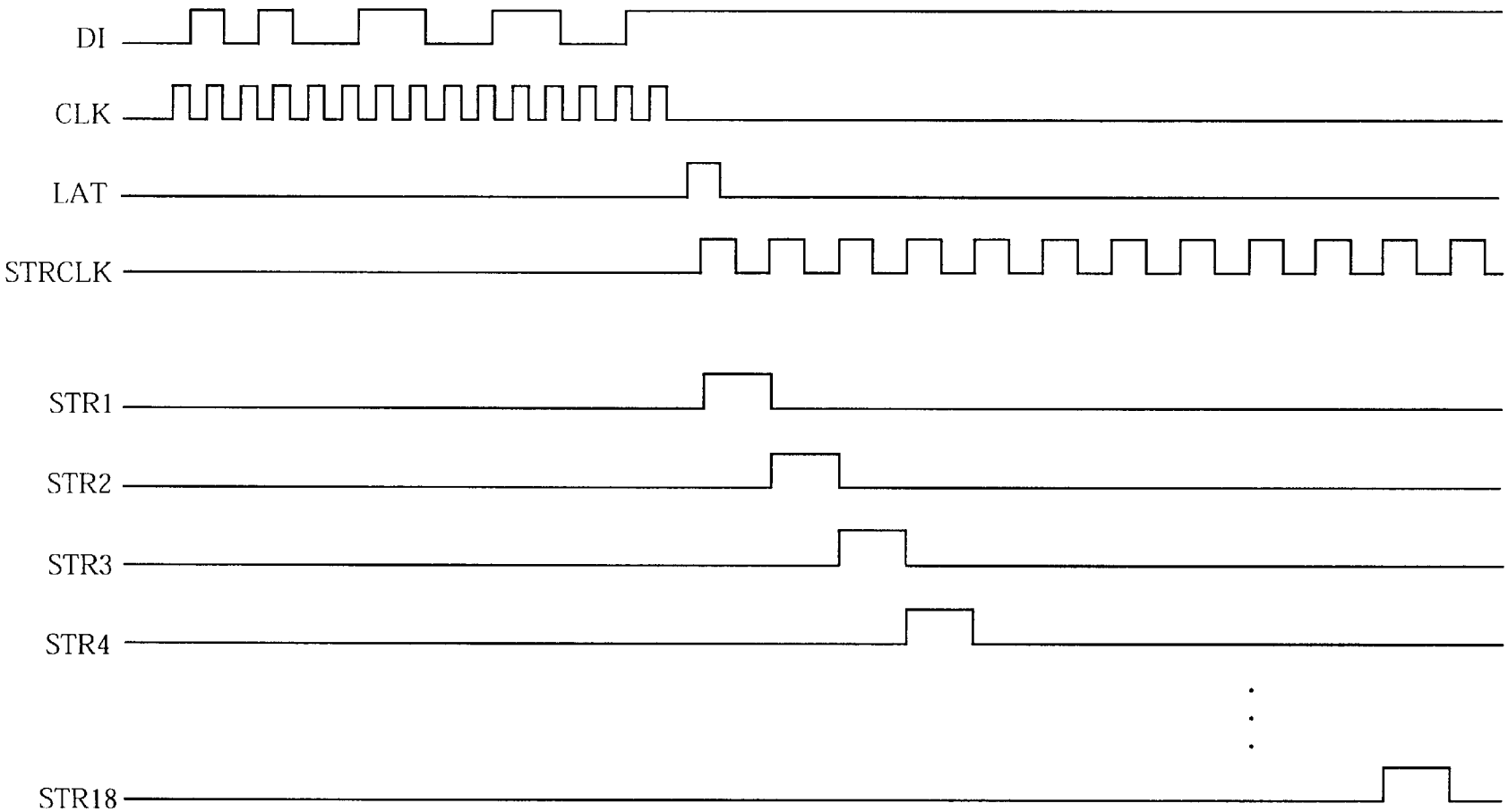
FIG. 6 is a timing chart of various signals related to the drive IC in FIG. 5.

FIG. 6 is a timing chart showing various signals. DI represents a record image data, CLK represents a clock signal, LAT represents a latch signal, and STRCLK represent a strobe clock signal. STRj ($1 \leqq j \leqq 18$) represents a strobe signal outputted from the D flip-flop circuit DFF of the drive IC DRj.

Figure 7:
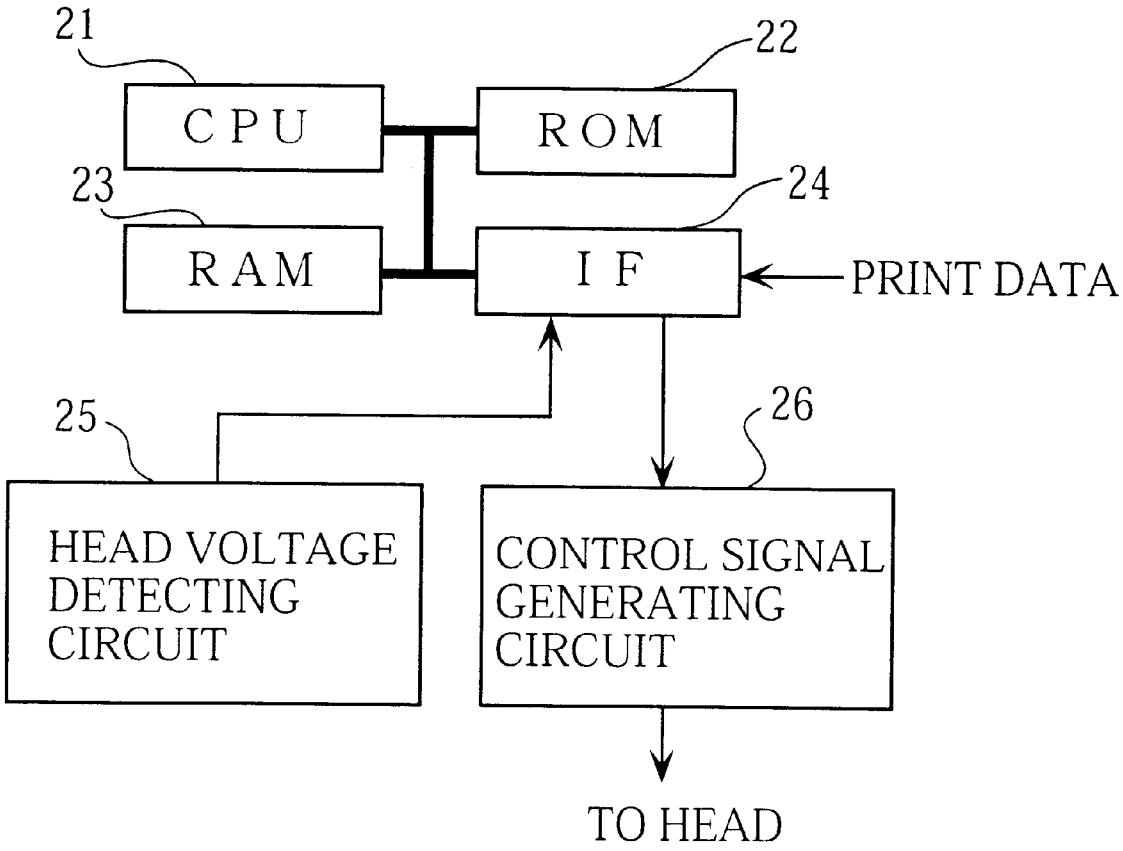
FIG. 7 is a circuit block diagram showing a principal portion of a printer which incorporates the thermal printhead in FIG. 1.

FIG. 7 is a circuit block diagram, showing a principal portion of a portable printer incorporating the thermal printhead described above. As shown in this figure, the portable printer includes a CPU 21, a ROM 22, a RAM 23, an interface circuit 24, a head voltage detection circuit 25, and a control signal generation circuit 26.

The CPU (central processing unit) 21 controls the entire printer.

The ROM (read only memory) 22 stores a control program, various initial values, and so on.

The RAM (random access memory) 23 serves as a work area for the CPU 21. The work area is utilized for expansion of a print data for example.

The interface circuit 24 controls communication between the CPU 21 and such circuits as the head voltage circuit 25 and the control signal generation circuit 26.

The head voltage detection circuit 25 detects a head voltage supplied to the common electrode 7 via the connecter 4 and other components from a battery located outside of the figure.

The control signal generation circuit 26 operates, under the control by the CPU 21, generates a variety of signals such as clock signal, latch signal and strobe clock signal, for controlling the thermal printhead. These control signals are supplied from the control signal generation circuit 26 to the thermal printhead, together with the record image data, the head voltage and the logic voltage.

Next, an operation of the portable printer will be described.

First, a print data is supplied to the CPU 21 via the interface circuit 24. The print data undergoes a variety of processes (such as data expansion) and made into an image data. The image data goes through the interface circuit 24 and the control signal generation circuit 26, and is supplied to the pad DI of the first drive IC 3 (DR 1) of the thermal print head. The image data serially inputted to the pad DI of the drive IC 3 (DR 1), is then inputted to the input terminal of the shift register SR. In the shift register SR, the image data serially inputted in its first bit is forwarded to the next bit in synchronization with the clock signal which is inputted via the pad CLK. The image data thus forwarded to the last bit of the shift register SR is then outputted from the serial output terminal to the pad DO upon input of the next clock signal, and is then supplied to the pad DI of the second drive IC 3 (DR 2) via a wiring pattern on the substrate 1. In this way, a total of 1728 bits of image data, which is a product of a multiplication between 96 and 18, are stored in the shift registers SR of the 18 drive IC's 3. In each drive IC 3, the output terminal of the shift register SR assumes a high level or a low level depending on the image data.

Under the above state, a latch signal is inputted to the latch signal input terminal of the latch circuit LT via the pad LAT of each drive IC 3, whereupon the latch circuit LT stores the signal inputted at the input terminal (i.e. the image data) , that is the signal at the output terminal of the shift register SR. As a result, the output terminal of the latch circuit LT assumes the high level or the low level depending on the image data.

The latch signal is also inputted to the first input terminal T1 of the AND circuit AND 97 via the pad STRI of the first drive IC 3 (DR 1). Here, if the output terminal Q of the D flip-flop circuit DFF is at the low level, this low level signal is inverted to the high level signal by the inverter IV, and is inputted to the second input terminal T2 of the AND circuit AND 97. This makes the output terminal of the AND circuit AND 97 assume the high level, and this high level signal is inputted to the input terminal D of the D flip-flop circuit DFF. With the above, when a strobe clock signal, which is inputted to the clock signal input terminal C of the D flip-flop circuit via the pad STRCLK, turns to the high level, a strobe signal which is an output from the D flip-flop circuit turns to the high level. This strobe signal is inputted to the first input terminal T1 of the AND circuits AND 1–AND 96, and to the pad STRI of the third drive IC 3 (DR3) via the pad STRO and the wiring pattern on the substrate 1.

In the first drive IC 3 (DR1) a strobe signal is generated based on the latch signal and the strobe clock signal. In the second drive IC 3 (DR2) , a new strobe signal is generated based on the strobe signal generated in the first drive IC 3 and the strobe clock signal. Further, in the third drive IC3 (DR3), anew strobe signal is generated based on the strobe signal generated in the second drive IC 3 and the strobe clock signal. As a result, strobe signals STR1–STR18 in the first through the 18th drive IC's 3 take waveforms as shown in FIG. 6. Each of the strobe signals TR1–STR18 assumes the high level only for a period of strobe clock signal. There is no time-series overlap between the high level portions of the strobe signals TR1–STR18.

More specifically, when the latch signal is inputted to the D flip-flop circuit DFF of the first drive IC 3 (DR1), the output from the D flip-flop circuit DFF assumes the high level upon the rise of the next strobe clock signal. When the strobe clock signal rises again the next time, the latch signal has already turned into the low level. Therefore, the output from the D flip-flop circuit DFF turns from the high level to the low level. Thus, the D flip-flop circuit DFF outputs a strobe signal that assumes the high level only for a time corresponding to one period of the strobe clock signal.

Next, this strobe signal is inputted to the D flip-flop circuit DFF of the second drive IC 3 via the AND circuit AND 97. This causes the D flip-flop circuit DFF of the second drive IC 3 to rise at the same time with the fall of the strobe signal generated by the D flip-flop circuit DFF of the first drive IC 3. As a result, a strobe signal that assumes the high level only for a time corresponding to one period of the strobe clock signal is outputted. In this way, the D flip-flop circuits of the 18 drive IC's sequentially generate new strobe signals.

As shown in FIG. 5, each drive IC 3 includes the inverter IV and the AND circuit AND 97. Therefore, the input of the D flip-flop circuit DFF can assume the high level only when the output from the D flip-flop circuit DFF is at the low level. Thus, the high level output from the D flip-flop circuit (i.e. the strobe signal) does not continue for two or longer periods of the strobe clock signal due to e.g. noise.

In each drive IC 3, when the output from the D flip-flop circuit DFF (the strobe signal) assumes the high level, this high level signal is inputted to the first input terminal T1 of the AND circuits AND 1–AND 96. Therefore, out of the AND circuits AND 1–AND 96, those AND circuits have their respective output terminals turn on if the outputs from their corresponding latch circuits LT are high level in accordance with the record data. As a result, corresponding field effect transistors out of the field effect transistors FET 1–FET 96 turn on. The drains of the field effect transistors FET 1–FET 96 are connected to respective individual electrodes 8 via the pads DO 1–DO 96 shown in FIG. 3. Therefore, if any of the field effect transistors FET 1–FET 96 turns on, the corresponding heating element 6 turns on to heat and make record on the recording paper. This recording is sequentially performed 18 times (as many as the drive IC's 3) timed by the strobe signal.

The printing thus performed by the above operation is as much as for one line in the primary scanning direction, but for a half of the line in the sub-scanning direction. Specifically, the effective print length A provided by each heating element 6 in the sub-scanning direction is generally half the size of the length B of the pixel to be printed in the sub-scanning direction. Therefore, in the sub-scanning direction, half of the each pixel has been printed so far.

Thus, the printhead is moved relatively to the recording paper by a distance equal to half the pixel in the sub-scanning direction, and then printing is made for the remaining half of the line. This printing is performed using the printing data already supplied, and by an input of the latch signal to the pad LAT.

The operation thus far described above completes the line of printing. By repeating the operation for a plurality of times, printing of a predetermined image can be made on the printing paper.

The head voltage detected by the head voltage detection circuit 25 (FIG. 7) is supplied, as a head voltage data, to the CPU 21 via the interface circuit 24. Based on this data, the CPU 21 controls the control signal generation circuits 26, and varies the period of the strobe clock signal depending on the head voltage. Specifically, with decrease in the head voltage, the period of the strobe clock signal is increased, whereby a duration of time for which the heating element is energized is increased. As a result, printing speed is decreased but printing quality is maintained at a constant level.

As has been described, by varying the pulse width of the head voltage, it becomes possible to set the head voltage in a wide range (from 2.7 volts to 8.5 volts for example). Further, as has been described, the field effect transistors FET 1–FET 96 can be turned on under a favorably reduced resistance, which enables to reduce power consumption.

Further, according to the present invention, the head voltage detection circuit 25 detects the head voltage, and the head voltage pulse width for the printing is automatically varied in accordance with the head voltage. Therefore, there is no need to provide an expensive component such as a DC—DC converter.

Further, since the drive IC 3 is not provided with a voltage reduction circuit, the logic voltage can be set in a wide range (from 2.7 volts to 5.5 volts for example), without providing such components as the DC—DC converter.

Further, the head voltage and the logic voltage can be set independently of each other. Therefore, it becomes possible to use the same voltage value for both the head 10 voltage and the logic voltage, or use different values, depending on various design conditions.

Still further, print timing is differentiated for each of the drive IC's, and printing of one line is completed by two printing strokes in the sub-scanning direction. These enable to reduce electric current that flows through the common electrode 7 and the grounding line, making possible to save power and reduce power consumption. In addition, since the printing of one line is completed by two strokes of printing in the sub-scanning direction, it becomes possible to reduce electric current that flows through the field effect transistors FET 1–FET 96 of the drive IC 3. As a result, it becomes possible to reduce resistance of the field effect transistors FET 1–FET 96 during operation.

According to the above embodiment, the effective print length A provided by the heating element 6 in the sub-scanning direction is generally half the size of the length B of the pixel in the sub-scanning direction. Alternatively, however, the effective print length A may be generally 1/n times (1 ≧3) and the printing of one line be completed by n-time strokes of the printing in the sub-scanning direction.

Further, according to the above embodiment, print timing is differentiated for each of the drive IC's, but the arrangement may not necessarily be such.

Further, according to the above embodiment, a total of 18 drive IC's each controlling 96 heating elements are mounted on the substrate 1. However, the present invention is obviously not limited by these numbers.

Still further, according to the above embodiment, the thermal printhead offered by the present invention is applied to a portable printer. However, the thermal printhead according to the present invention is also applicable to a copier, facsimile machine and so on.

The present invention having been thus far described, it is obvious that the invention can be varied in many ways. Such variations are not deviations from the spirit and scope of the present invention, but all such variations obvious to those skilled in the art should be included in the accompanied claims.

What is claimed is:

1. A thermal printhead comprising:

a plurality of heating elements heated by a head voltage for printing on a recording paper;

a plurality of drive IC's powered by a logic voltage for driving the heating elements;

means for causing the heating elements to perform the printing even if the head voltage varies within a range from 2.7 volts through 8.5 volts; and means for causing the drive IC's operate even if the logic voltage varies within a range from 2.7 volts through 5.5 volts.

2. The thermal printhead according to claim 1, further comprising means for setting the head voltage and the logic voltage independently of each other.

3. The thermal printhead according to claim 1, further comprising voltage varying means for varying a pulse width of the head voltage during the printing in response to variation in the head voltage.

4. The thermal printhead according to claim 1, wherein each of the heating elements has an effective print length in a sub-scanning direction, a pixel to be printed per printing datum having a print length in the sub-scanning direction, the effective print length being generally equal to an n-th of the print length, with n being a natural number not smaller than 2.

5. The thermal printhead according to claim 1, wherein each of the drive IC's incorporates a plurality of transistors connected to the heating elements.

6. The thermal printhead according to claim 5, wherein the transistors are MOS field effect transistors.

7. A printer comprising:

power supply means;

a thermal printhead including a plurality of heating elements heated by a head voltage for printing on a recording paper, and a plurality of drive IC's powered by a logic voltage for driving the heating elements;

means for causing the heating elements to perform the printing even if the head voltage varies within a range from 2.7 volts through 8.5 volts; and means for causing the drive IC's operate even if the logic voltage varies within a range from 2.7 volts through 5.5 volts.

8. The printer according to claim 7, wherein the power supply means includes a battery.

* * * * *